US010930260B2

(12) United States Patent
Christoph

(10) Patent No.: US 10,930,260 B2
(45) Date of Patent: Feb. 23, 2021

(54) ENGINE ORDER AND ROAD NOISE CONTROL

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/768,722

(22) PCT Filed: Oct. 10, 2016

(86) PCT No.: PCT/IB2016/056047
§ 371 (c)(1),
(2) Date: Apr. 16, 2018

(87) PCT Pub. No.: WO2017/064604
PCT Pub. Date: Apr. 20, 2017

(65) Prior Publication Data

US 2019/0066650 A1 Feb. 28, 2019

(30) Foreign Application Priority Data

Oct. 16, 2015 (EP) ..... 15190175

(51) Int. Cl.
*G10K 11/178* (2006.01)

(52) U.S. Cl.
CPC ..... *G10K 11/17823* (2018.01); *G10K 11/178* (2013.01); *G10K 11/17825* (2018.01);
(Continued)

(58) Field of Classification Search
CPC ..... G10K 11/17823; G10K 11/17825; G10K 11/17881; G10K 11/17883;
(Continued)

(56) References Cited

U.S. PATENT DOCUMENTS 5,245,664 A 9/1993 Kinoshite et al.
5,325,437 A * 6/1994 Doi ..... G10K 11/178 381/71.9
(Continued)

FOREIGN PATENT DOCUMENTS

EP 2133866 A1 12/2009
JP 05-053589 A 3/1993
(Continued)

OTHER PUBLICATIONS

English Translation of Office Action dated Oct. 23, 2020 for Japanese Application No. 2018-516457 filed Mar. 29, 2018, 7 pgs.

*Primary Examiner* — Ping Lee
(74) *Attorney, Agent, or Firm* — Brooks Kushman P.C.

(57) ABSTRACT

Exemplary engine order and road noise control systems and methods include directly picking up road noise from a structural element of a vehicle to generate a first sense signal representative of the road noise, detecting harmonics of an engine of the vehicle to generate a second sense signal representative of the engine harmonics, and combining the first sense signal and the second sense signal to provide a combination signal representing the combination of the first sense signal and the second sense signal. The systems and methods further include broadband active noise control filtering to generate a filtered combination signal, and converting the filtered combination signal from the active noise control filtering into anti-noise and radiating the anti-noise to a listening position in an interior of the vehicle. The filtered combination signal is configured so that the anti-noise reduces the road noise and engine sound at the listening position.

17 Claims, 4 Drawing Sheets

(52) U.S. Cl.
CPC .. *G10K 11/17881* (2018.01); *G10K 11/17883* (2018.01); *G10K 2210/129* (2013.01); *G10K 2210/1282* (2013.01); *G10K 2210/3027* (2013.01); *G10K 2210/3031* (2013.01); *G10K 2210/3032* (2013.01); *G10K 2210/3044* (2013.01); *G10K 2210/3046* (2013.01); *G10K 2210/501* (2013.01); *G10K 2210/512* (2013.01)

(58) Field of Classification Search
CPC ... G10K 2210/1282; G10K 2210/3044; G10K 2210/501; G10K 2210/3032; G10K 2210/3046; G10K 2210/129
See application file for complete search history.

(56) References Cited

U.S. PATENT DOCUMENTS

| | | | | |
|---|---|---|---|---|
| 2002/0076059 | A1* | 6/2002 | Joynes | G10K 11/178 381/71.6 |
| 2010/0014685 | A1* | 1/2010 | Wurm | G10K 11/178 381/71.11 |
| 2010/0290635 | A1* | 11/2010 | Shridhar | G10K 11/178 381/71.1 |
| 2011/0235693 | A1* | 9/2011 | Lee | H04S 7/00 375/224 |

FOREIGN PATENT DOCUMENTS

| | | | |
|---|---|---|---|
| JP | 2010264974 | A | 11/2010 |
| WO | 2015023707 | A1 | 2/2015 |

* cited by examiner

ENGINE ORDER AND ROAD NOISE CONTROL

CROSS-REFERENCE TO RELATED APPLICATION

This application is the U.S. national phase of PCT Application No. PCT/IB32016/056047 filed on Oct. 10, 2016, which claims priority to EP Patent Application No. 15190175.8 filed on Oct. 16, 2015, the disclosures of which are incorporated in their entirety by reference herein.

FIELD

The disclosure relates to engine order and road noise control systems and methods.

BACKGROUND

Road noise control (RNC) technology reduces unwanted road noise inside a car by generating anti-noise, i.e., sound waves that are opposite in phase to the sound waves to be reduced, in a similar manner as with active noise control (ANC) technology. RNC technology uses noise and vibration sensors to pick up unwanted noise and vibrations generated by tires, car body components, and rough road surfaces that cause or transfer noise and vibrations. The result of canceling such noise is a more pleasurable ride and it enables car manufacturers to use lightweight chassis materials, thereby increasing fuel mileage and reducing emissions. Engine order cancellation (EOC) technology uses a non-acoustic signal such as a repetitions-per-minute (RPM) sensor representative of the engine noise as a reference to generate a sound wave that is opposite in phase to the engine noise audible in the car interior. As a result, EOC makes it easier to reduce the use of conventional damping materials. In both systems, additional error microphones mounted in the car interior may provide feedback on the amplitude and phase to refine noise reducing effects. However, the two technologies require different sensors and different signal processing in order to observe engine order and road noise related noise so that commonly two separate systems are used side by side.

SUMMARY

An exemplary engine order and road noise control system includes a first sensor configured to directly pick up road noise from a structural element of a vehicle, and to generate a first sense signal representative of the road noise, a second sensor configured to detect harmonics of an engine of the vehicle and to generate a second sense signal representative of the engine harmonics, and an adder configured to combine the first sense signal and the second sense signal to provide a combination signal representing a combination of the first sense signal and the second sense signal. The system further includes a broadband active noise control filter configured to generate a filtered combination signal from the combination signal, and a loudspeaker configured to convert the filtered combination signal provided by the active noise control filter into anti-noise and to radiate the anti-noise to a listening position in an interior of the vehicle. The filtered combination signal is configured so that the anti-noise reduces the road noise and engine sound at the listening position.

An exemplary engine order and road noise control method includes directly picking up road noise from a structural element of a vehicle to generate a first sense signal representative of the road noise, detecting harmonics of an engine of the vehicle to generate a second sense signal representative of the engine harmonics, and combining the first sense signal and the second sense signal to provide a combination signal representing a combination of the first sense signal and the second sense signal. The method further includes broadband active noise control filtering to generate a filtered combination signal from the combination signal, and converting the filtered combination signal provided by the active noise control filtering into anti-noise and radiating the anti-noise to a listening position in an interior of the vehicle. The filtered combination signal is configured so that the anti-noise reduces the road noise and engine sound at the listening position.

BRIEF DESCRIPTION OF THE DRAWINGS

The disclosure may be better understood by reading the following description of non-limiting embodiments in connection with the attached drawings, in which like elements are referred to with like reference numbers, wherein below.

DETAILED DESCRIPTION

Figure 1:
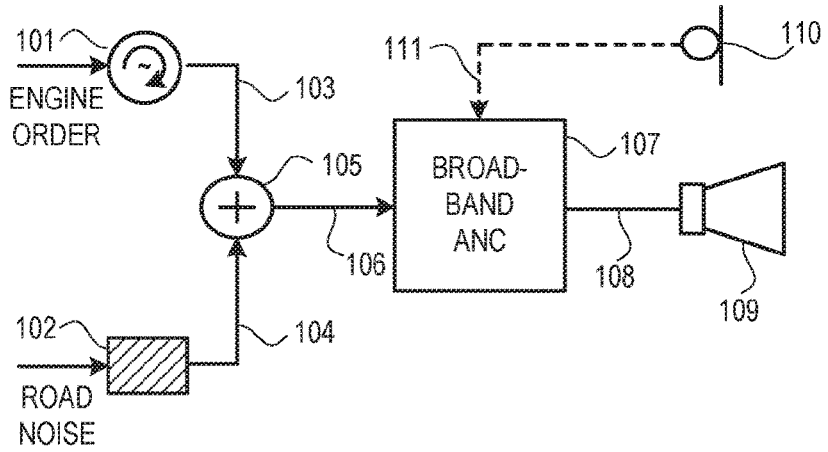
FIG. 1 is a schematic diagram illustrating a simple exemplary engine order and road noise control system.

Noise is generally the term used to designate sound that does not contribute to the informational content of a receiver, but rather is perceived to interfere with the audio quality of a desired signal. The evolution process of noise can be typically divided into three phases. These are the generation of the noise, its propagation (emission) and its perception. It can be seen that an attempt to successfully reduce noise is initially aimed at the source of the noise itself, for example, by attenuation and subsequently by suppression of the propagation of the noise signal. Nonetheless, the emission of noise signals cannot be reduced to the desired degree in many cases. In such cases, the concept of removing undesirable sound by superimposing a compensation signal is applied.

Known methods and systems for canceling or reducing emitted noise suppress unwanted noise by generating cancellation sound waves to superimpose on the unwanted signal, whose amplitude and frequency values are for the most part identical to those of the noise signal, but whose phase is shifted by 180 degrees in relation to the noise. In ideal situations, this method fully extinguishes the unwanted noise. This effect of targeted reduction of the sound level of a noise signal is often referred to as destructive interference or noise control. In vehicles, the unwanted noise can be caused by effects of the engine, the tires, suspension and other units of the vehicle, and therefore varies with the speed, road conditions and operating states in the vehicle.

Common EOC systems utilize for the engine noise control a narrowband feed-forward active noise control (ANC) framework in order to generate anti-noise by adaptive filtering of a reference signal that represents the engine harmonics to be cancelled. After being transmitted via a secondary path from an anti-noise source to a listening position, the anti-noise has the same amplitude but opposite phase as the signals generated by the engine and filtered by a primary path that extends from the engine to the listening position. Thus, at the place where an error microphone resides in the room, i.e., at or close to the listening position, the overlaid acoustical result would ideally become zero so that error signals picked up by the error microphone would only record sounds other than the (cancelled) harmonic noise signals generated by the engine. Commonly, a non-acoustic sensor, for example, a sensor measuring the repetitions-per-minute (RPM), is used as a reference.

RPM sensors, including crankshaft sensors, may be, for example, hall sensors which are placed adjacent to a spinning steel disk. Other detection principles can be employed such as an optical sensor or inductive sensor. A crank sensor is an electronic device basically used in an internal combustion engine to monitor the position or rotational speed of the crankshaft. This information is used by engine management systems to control ignition system timing and other engine parameters. Thus, the functional objective for the crankshaft position sensor is to determine the position and/or rotational speed (RPM) of the crank. It is also commonly used as the primary source for the measurement of engine speed in revolutions per minute (RPM). The signal from the RPM sensor can be used as a synchronization signal for generating an arbitrary number of synthesized harmonics corresponding to the engine harmonics. The synthesized harmonics form the basis for noise canceling signals generated by a subsequent narrowband feed-forward ANC system.

In common RNC systems, airborne and structure-borne noise sources are monitored by noise and vibration sensors such as acceleration sensors in order to provide the highest possible road noise reduction performance. For example, acceleration sensors used as input noise and vibration sensors may be disposed throughout the vehicle to monitor the structural behavior of the suspension and other axle components. RNC systems utilize a broadband feed-forward active noise control (ANC) framework in order to generate anti-noise by adaptive filtering of the signal from the noise and vibration sensor that represents the road noise to be cancelled. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration, and can be used to sense orientation, coordinate acceleration, motion, vibration, and shock. As can be seen, the noise sensors and the subsequent signal processing in EOC and RNC systems are different.

Referring to FIG. 1, a simple engine order and road noise control system includes an RPM sensor 101 which provides a square-wave RPM signal representative of the harmonics of the engine and, thus, of a considerable share of the engine noise, and an acceleration sensor 102 which is provided to directly pick up road noise. Directly picking up includes essentially picking up the signal in question without significant influence by other signals. Signals 103 and 104 output by the sensors 101 and 102 represent the engine order noise and the road noise, respectively, and are combined, e.g., summed up by an adder 105 to form a sum signal 106 representative of the combined engine order and road noise. Alternative ways of combining signals may include subtracting, mixing, cross-over filtering etc. The sum signal 106 is supplied to a broadband ANC filter 107 which provides a filtered sum signal 108 to a loudspeaker 109. The filtered sum signal 108, when broadcasted by the loudspeaker 109 to a listening position (not shown), generates at the listening position anti-noise, i.e., sound with the same amplitude but opposite phase as the engine and road noise that appears at the listening position, to reduce or even cancel the unwanted noise at the listening position. The broadband ANC filter 107 may have a fixed or adaptive transfer function and may be a feedback system or a feedforward system or a combination thereof. The acceleration sensor 102 may be substituted by an acoustic sensor under certain conditions. Furthermore, an error microphone 110 may be employed, which picks up the residual noise at the listening position and provides an error signal 111 representative of the residual noise.

When an acoustic sensor is used to pick up engine noise, the sensor should not be prone to pick up acoustical feedback signals from the loudspeaker. But if sufficiently well insulated from the loudspeaker, which may be the case if a microphone is directly mounted to the engine block at a preferred position (e.g. close to the crankshaft and valves) and sufficiently well decoupled from the sound in the interior by the front console and hood, an acoustic sensor similar to a stethoscope may also be used in order to pick up exclusively the broadband engine noise signals.

In the engine order and road noise system shown in FIG. 1, an RPM sensor is employed in connection with accordingly adapted broadband signal processing to pick-up the engine noise that arises from the engine harmonics, in contrast to common EOC systems which use narrowband teed-forward ANC. Furthermore, in this engine order and road noise system, the same broadband ANC algorithm is used in combination with an additional sensor for RNC. Since adaptation rates of narrowband feed-forward ANC systems as used in EOC are usually high, it is likely that the traceability property of a broadband engine noise control system will be worse than that of an EOC system, unless certain measures are taken. However, broadband RNC and the combination of EOC and RNC in one common framework enhances the efficiency of the overall system. Sensors that are able to pick up broadband engine noise signals require a subsequent signal processing other than the previously used narrowband teed-forward ANC system which is unable to cope with broadband reference signals. For example, a suitable ANC system is a broadband feed-forward ANC framework employing a least mean square (LMS) algorithm. If a filtered-x least mean square (FXLMS) algorithm has been chosen for this task, one efficient combination of these two algorithms may be as depicted in FIG. 2.

Figure 2:
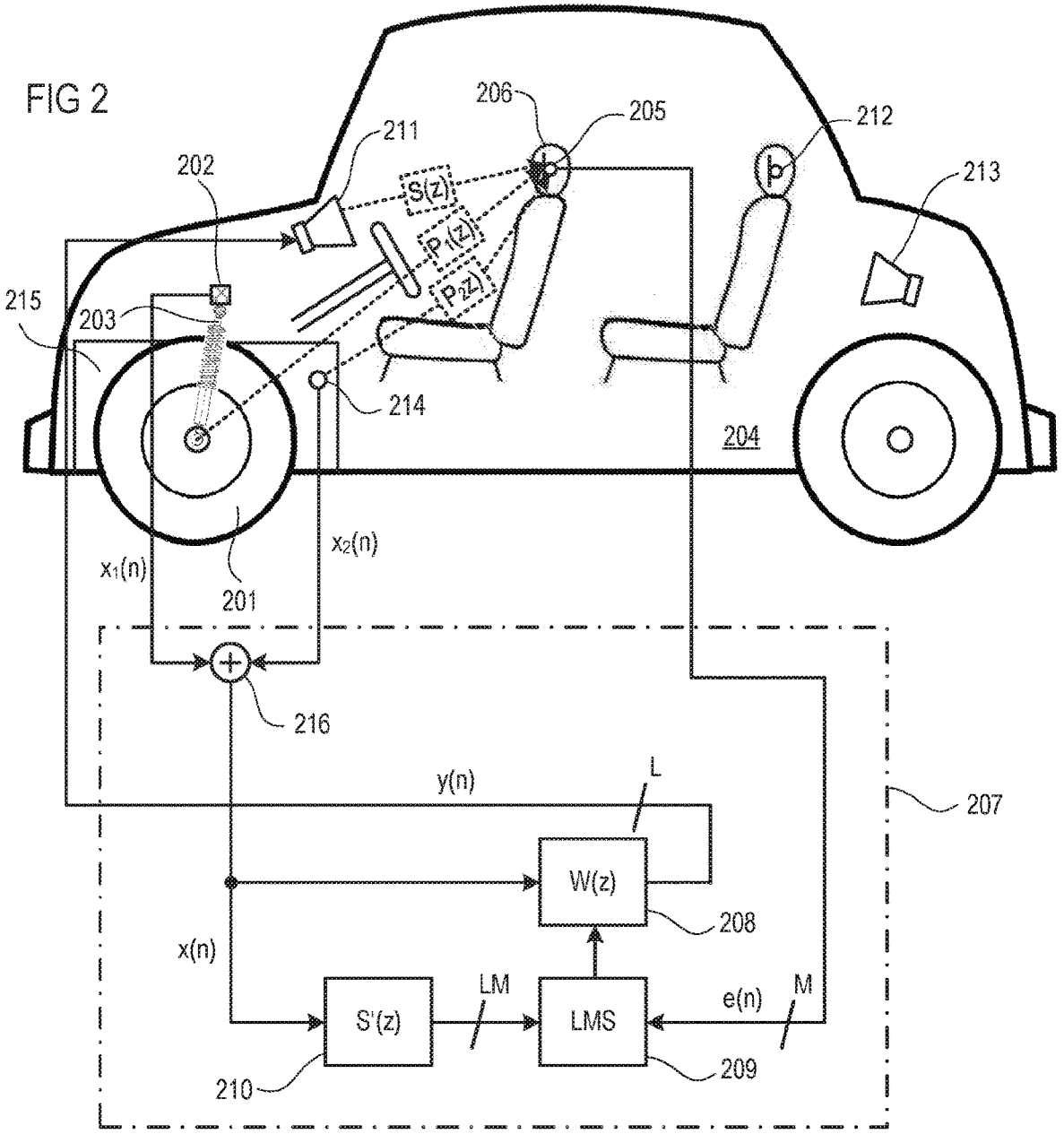
FIG. 2 is a schematic diagram illustrating an exemplary engine order and road noise control system using a filtered-x least mean square algorithm.

A single-channel feedforward active engine order and road noise system with FXLMS algorithm is shown in FIG. 2. Noise (and vibrations) that originate from a wheel 201 moving on a road surface are directly picked up by an acceleration sensor 202 which is mechanically coupled with a suspension device 203 of an automotive vehicle 204 and which outputs a noise and vibration signal $x_1(n)$ that represents the detected noise (and vibrations) and, thus, correlates with the road noise audible within the cabin. The road noise originating from the wheel 201 is mechanically and/or acoustically transferred via a first primary path to the microphone 205 according to a transfer characteristic $P_1(z)$. Engine order control includes an RPM sensor 214 which is mounted to an engine 215 of the vehicle 204. Noise that originates from the harmonics of engine 215 is detected by the RPM sensor 214 which outputs an RPM signal $x_2(n)$ that represents the engine noise and, thus, correlates with the engine noise audible within the cabin. The RPM signal $x_2(n)$ may be a square-wave signal having the frequency of the fundamental engine harmonic, the harmonics as individual signals or the sum of the individual harmonics. The engine noise is mechanically and/or acoustically transferred via a second primary path to the microphone 205 according to a transfer characteristic $P_2(z)$. As the first primary path and the second primary path are quite similar, the transfer characteristics $P_1(z)$ and $P_2(z)$ can be assumed to be P(z). As the signals $x_1(n)$ and $x_2(n)$ are both transferred via a transfer function P(z), the two signals can be summed up, e.g., by an adder 216 which provides a sum signal x(n).

At the same time, an error signal e(n) representing the sound, including noise, present in the cabin of the vehicle 204 is detected by a microphone 205 which may be arranged within the cabin in a headrest 206 of a seat (e.g., the driver's seat). A transfer characteristic W(z) of a controllable filter 208 is controlled by an adaptive filter controller 209 which may operate according to the known least mean square (LMS) algorithm based on the error signal e(n) and on the sum signal x(n) filtered with a transfer characteristic S'(z) by a filter 210, wherein $W(z)=-P(z)/S(z)$. $S'(z)=S(z)$ and S(z) represents the transfer function between the loudspeaker 211 and the microphone 205, i.e., the transfer function S(z) of a secondary path. A signal y(n) that, after having travelled through the secondary path, has a waveform inverse in phase to that of the engine order and road noise audible within the cabin is generated by an adaptive filter formed by controllable filter 208 and filter controller 209, based on the thus identified transfer characteristic W(z) and the sum signal x(n). From signal y(n), after it has travelled through the secondary path, sound with a waveform inverse in phase to that of the engine order and road noise audible within the cabin is generated by the loudspeaker 211, which may be arranged in the cabin, to thereby reduce the engine order and road noise within the cabin.

The exemplary system shown in FIG. 2 employs a straightforward single-channel feedforward filtered-x LMS control structure 207, but other control structures, e.g., multi-channel structures with a multiplicity of additional channels, a multiplicity of additional microphones 212, and a multiplicity of additional loudspeakers 213, may be applied as well. For example, in total, L loudspeakers and M microphones may be employed. Then, the number of microphone input channels into filter controller 209 is M, the number of output channels from filter 208 is L and the number of channels between filter 210 and filter control 209 is L·M.

Figure 3:
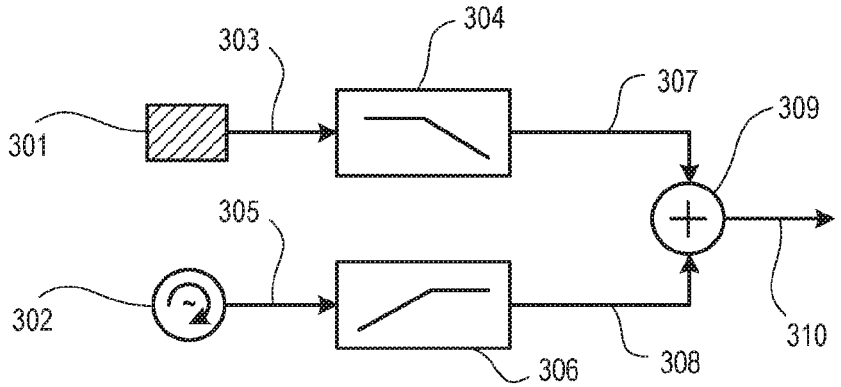
FIG. 3 is a schematic diagram illustrating an exemplary combination of acceleration sensor and an RPM sensor.

To pick-up engine noise, an acceleration sensor 301 may be combined with an RPM sensor 302 as shown in FIG. 3. A sense signal 303 output by acceleration sensor 301 is filtered by a subsequent low-pass-filter 304 and a sense signal 305 output by RPM sensor 302 is filtered by a subsequent high-pass filter 306. A filtered sense signal 307 output by low-pass-filter 304 and a filtered sense signal 308 output by high-pass filter 306 are summed up by means of an adder 309 to provide a reference signal 310. The low-pass-filter 304 and the high-pass filter 306 form a cross-over network so that signal components in the lower frequency range of the reference signal 310 originate from the acceleration sensor 301 and signal components in the higher frequency range of the reference signal 310 originate from the RPM sensor 302. In the example shown in FIG. 3, the RPM sensor 302 outputs a square-wave signal with a single frequency that corresponds to the RPM of the engine. Alternatively, the high-pass filter 306 may be substituted by a harmonic generator that generates harmonics of the single frequency that corresponds to the RPM of the engine, wherein the harmonics may be restricted to harmonics at only higher frequencies.

Figure 4:
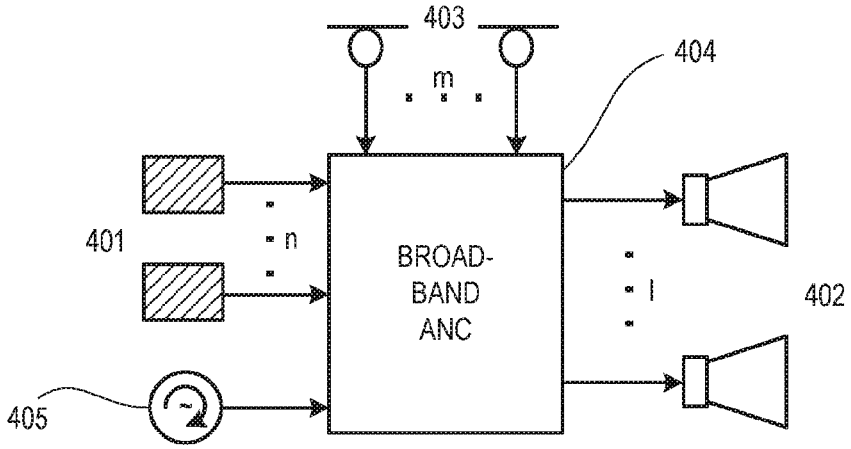
FIG. 4 is a schematic diagram illustrating an exemplary multi-channel active engine noise control system with a square-wave RPM input.

FIG. 4 shows an active engine noise control system which is a multi-channel type system capable of suppressing noise from a plurality of sensors. The system shown in FIG. 4 comprises n acceleration sensors 401, l loudspeakers 402, m microphones 403, and an adaptive active noise control module 404 which operates to minimize the error between noise from noise and vibration sources of the engine (primary noise) and cancelling noise (secondary noise). The adaptive active noise control module 404 may include a number of control circuits provided for each combination of microphones 403 and loudspeakers 402, wherein the loudspeakers 402 create cancelling signals for cancelling noise from the noise and vibration sources. The active engine noise control system further includes an RPM sensor 405 that is connected to the adaptive active noise control module 404. The RPM sensor 405 may provide a square-wave signal that corresponds to the RPM of the engine to the adaptive active noise control module 404. The acceleration sensors 401 may each be linked to a specific (matrix-wise) combination of one of microphones 402 and one of loudspeakers 402, which can each be seen as a single channel system.

Figure 5:
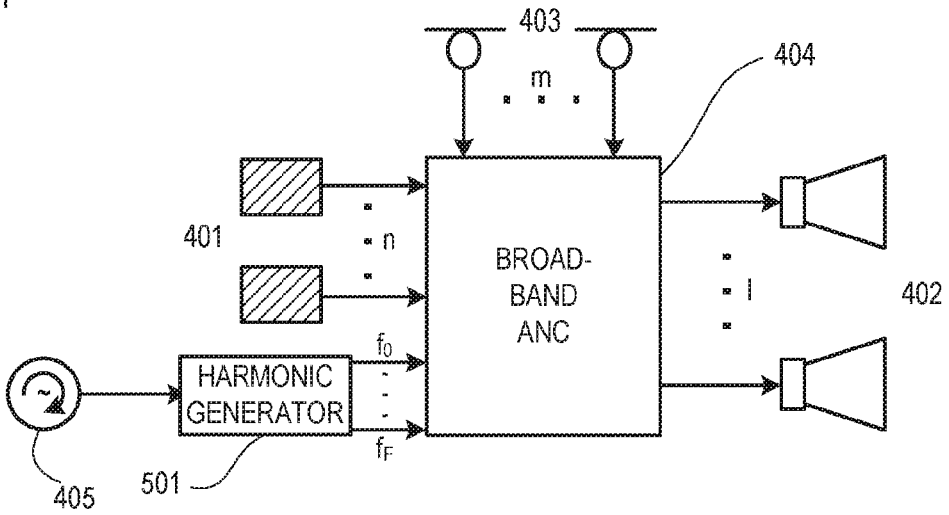
FIG. 5 is a schematic diagram illustrating the system shown in FIG. 4 with a harmonics input instead of the square-wave RPM input.
Figure 6:
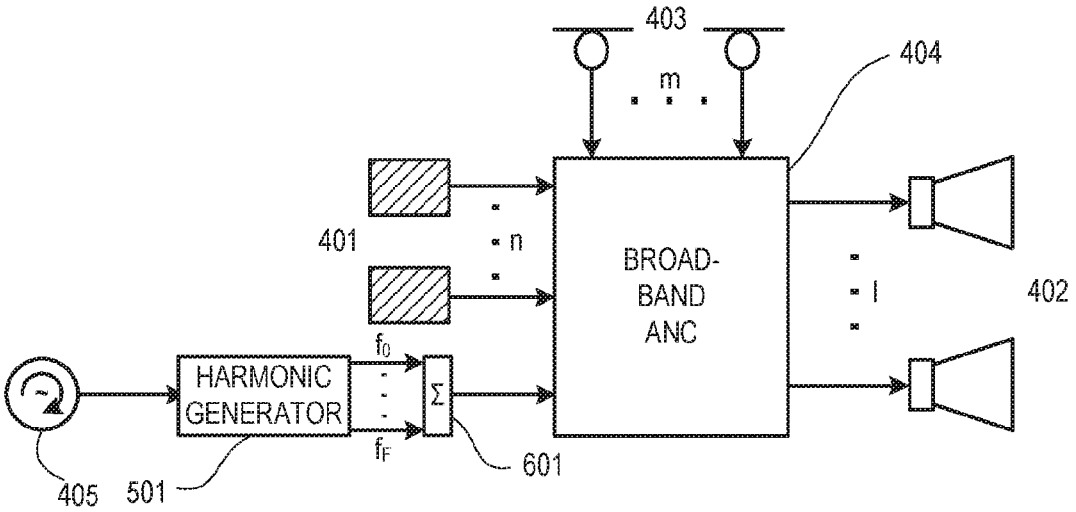
FIG. 6 is a schematic diagram illustrating the system shown in FIG. 4 with a summed-up harmonics input instead of the square-wave RPM input.

Referring to FIG. 5, the system shown in FIG. 4 may be modified so that the square wave output by the RPM sensor 405 is supplied to the adaptive active noise control module 404 via a harmonic generator 501 that synthesizes harmonics $f_0$ to $f_F$ from the fundamental frequency, i.e., first harmonic $f_0$, determined by the square-wave signal from the RPM sensor 405. Either all harmonics are input into the adaptive active noise control module 404 separately as shown in FIG. 5 or r summed up by a summer 601 to provide a single input as shown in FIG. 6. In the systems described above in connection with FIGS. 4 to 6, at least one of the acceleration sensors may be provided to pick up road noise so that these systems can be used for combined control of engine orders, engine noise and road noise.

Figure 7:
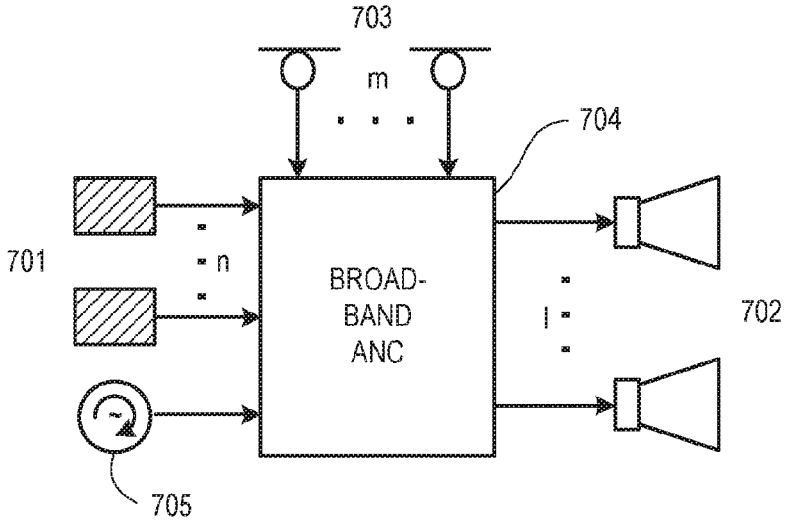
FIG. 7 is a schematic diagram illustrating an exemplary multi-channel engine order and road noise control system.

FIG. 7 shows a multi-channel active engine order and road noise control system which is a multi-channel type system capable of suppressing noise from a plurality of sensors. The system shown in FIG. 7 comprises n acceleration sensors 701, l loudspeakers 702, m microphones 703, and an adaptive active noise control module 704 which operates to minimize the error between noise from noise and vibration sources of the road (primary noise) and canceling noise (secondary noise). The adaptive active noise control module 704 may include a number of control circuits provided for each combination of microphones 703 and loudspeakers 702, wherein the loudspeakers 702 create cancelling signals for cancelling noise from the road noise and vibration sources. The active engine order and road noise control system further includes an RPM sensor 705 that is connected to the adaptive active noise control module 704. The RPM sensor 705 may provide to the adaptive active noise control module 704 a signal that corresponds to the RPM of the engine and that may be a square-wave having the frequency of the fundamental engine harmonic, the harmonics as individual signals or the sum of the individual harmonics. The acceleration sensors 701 and the RPM sensor 705 may each be linked to a specific combination of one of microphones 703 and one of loudspeakers 702, which each form a single-channel system.

Figure 8:
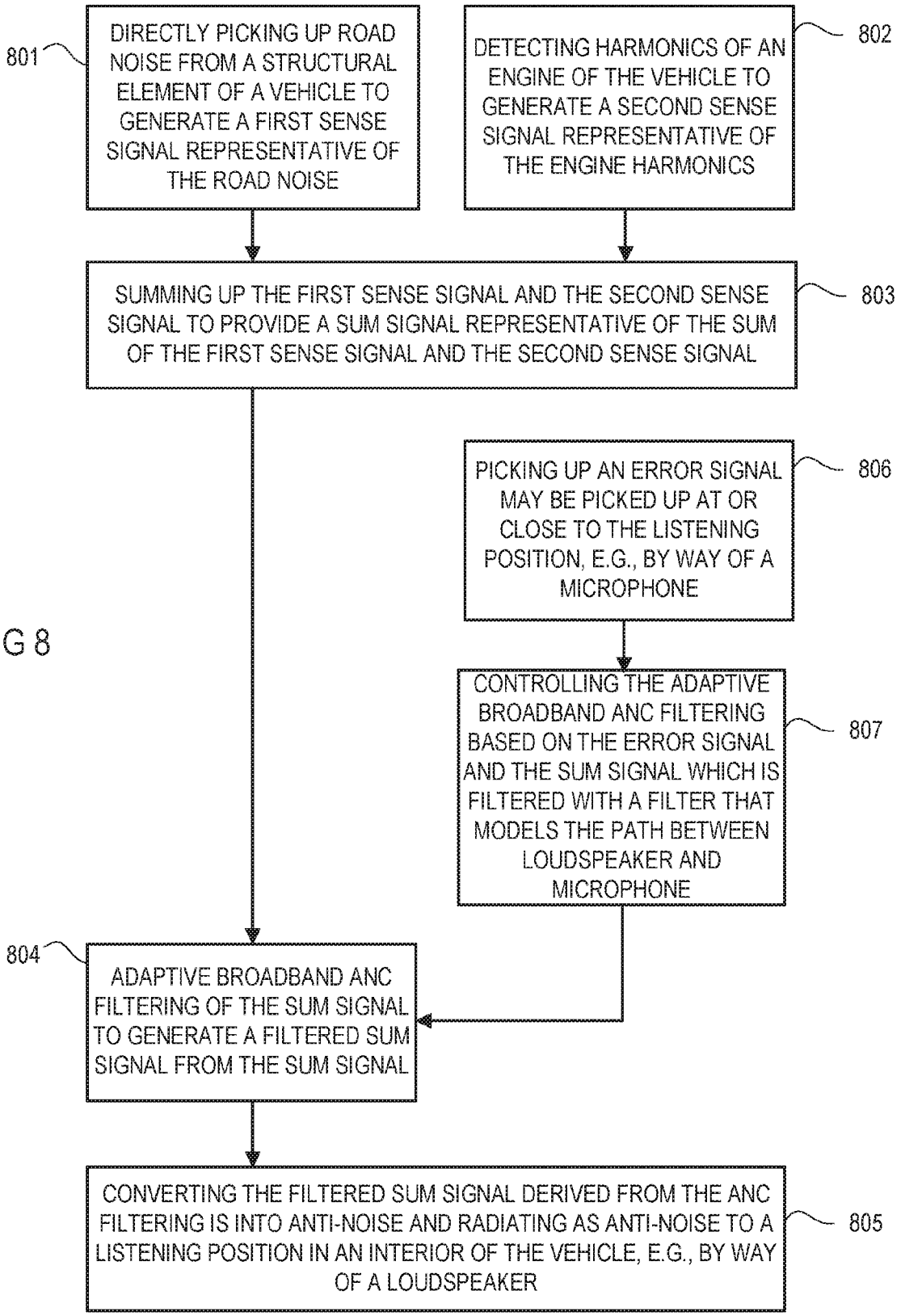
FIG. 8 is a flow chart illustrating an exemplary engine order and road noise control method.

Referring to FIG. 8, an exemplary engine order and road noise control method, as may be performed by one of the systems shown in FIGS. 1 and 2, may include directly picking up road noise from a structural element of a vehicle to generate a first sense signal representative of the road noise (procedure 801) and detecting harmonics of an engine of the vehicle to generate a second sense signal representative of the engine harmonics (procedure 802). The first sense signal and the second sense signal are combined, e.g., summed up to provide a sum signal representing the sum of the first sense signal and the second sense signal (procedure 803). The sum signal undergoes adaptive broadband ANC filtering, e.g., according to the FXLMS algorithm, to generate a filtered sum signal from the sum signal (procedure 804). Then, the filtered sum signal derived from the active noise control filtering is converted into anti-noise, e.g., by way of a loudspeaker, and radiated as anti-noise to a listening position in an interior of the vehicle (procedure 805). The filtered sum signal is configured so that the anti-noise reduces the road noise and engine sound at the listening position. Furthermore, an error signal may be picked up at or close to the listening position, e.g., by way of a microphone (procedure 806). The error signal and the sum signal which is filtered with a filter that models the path between loudspeaker and microphone are used to control the FXLMS algorithm of the adaptive broadband ANC filtering (procedure 807).

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The invention claimed is:

1. An engine order and road noise control system comprising:

a first sensor configured to directly pick up road noise from a structural element of a vehicle, and to generate a first sense signal representative of the road noise;

a repetitions-per-minute (RPM) sensor configured to output a square wave signal with a single frequency corresponding to the RPM of an engine of the vehicle;

a low-pass filter configured to filter the first sense signal and to generate a first filtered sense signal;

a high-pass filter configured to directly filter the square wave signal to generate a second filtered sense signal;

an adder configured to sum the first filtered sense signal and the second filtered sense signal to provide a sum signal representing the sum of the first filtered sense signal and the second filtered sense signal;

a broadband active noise control filter configured to generate a filtered sum signal from the sum signal; and a loudspeaker configured to convert the filtered sum signal provided by the broadband active noise control filter into anti-noise and to radiate the anti-noise to a listening position in an interior of the vehicle; wherein the filtered first signal and the filtered second signal are configured so that the anti-noise reduces the road noise and engine sound at the listening position.

2. The system of claim 1, wherein the broadband active noise control filter comprises:

a controllable filter electrically connected to the adder; and a filter controller configured to receive the sum signal and to control the controllable filter according to the sum signal.

3. The system of claim 2, further comprising a microphone disposed in the interior of the vehicle close at or adjacent to the listening position, wherein the microphone is configured to provide a microphone signal and the filter controller is configured to further control the controllable filter according to the microphone signal.

4. The system of claim 2, wherein the filter controller is configured to control the controllable filter according to a least mean square algorithm.

5. The system of claim 1, wherein the first sensor is an acceleration sensor attached to the structural element of the vehicle.

6. The system of claim 1, wherein the RPM sensor is electrically or mechanically connected to the engine of the vehicle.

7. The system of claim 1, wherein the second sensor is combined with an acoustic sensor disposed at or adjacent to the engine of the vehicle.

8. An engine order and road noise control method comprising:

directly picking up road noise from a structural element of a vehicle to generate a first sense signal representative of the road noise;

generating a square wave signal with a single frequency corresponding to a repetitions-per-minute (RPM) of an engine of the vehicle;

low-pass filtering of the first sense signal to generate a first filtered sense signal;

high-pass filtering to directly filter the square wave signal to generate a second filtered sense signal;

summing the first filtered sense signal and the second filtered sense signal to provide a sum signal representing the sum of the first filtered sense signal and the second filtered sense signal;

broadband active noise control filtering to generate a filtered sum signal from the sum; and converting the filtered sum signal provided by the broadband active noise control filtering into anti-noise and radiating the anti-noise to a listening position in an interior of the vehicle; wherein the filtered sum signal is configured so that the anti-noise reduces the road noise and engine sound at the listening position.

9. The method of claim 8, wherein the broadband active noise control filtering comprises controlled filtering of the sum signal to provide the filtered sum signal to be converted into anti-noise, wherein the filtering is controlled according to the sum signal.

10. The method of claim 9, further comprising picking up sound in the interior of the vehicle close at or adjacent to the listening position to provide a microphone signal, wherein the filtering is further controlled according to the microphone signal.

11. The method of claim 9, wherein the filtering is controlled according to a least mean square algorithm.

12. The method of claim 8, wherein the road noise is picked up from the structural element of the vehicle with an acceleration sensor attached to the structural element of the vehicle.

13. The method of claim 8, wherein the square wave signal is provided by a RPM sensor mechanically or electrically connected to the engine of the vehicle and/or engine noise is provided by an acoustic sensor acoustically connected to the engine of the vehicle.

14. An engine order and road noise control system comprising:

a first sensor configured to receive road noise from a structural element of a vehicle, and to generate a first sense signal representative of the road noise;

a repetitions-per-minute (RPM) sensor configured to output a square wave signal with a single frequency corresponding to the RPM of an engine of the vehicle;

a low-pass filter configured to filter the first sense signal and to generate a first filtered sense signal;

a high-pass filter configured to directly filter the square wave signal to generate a second filtered sense signal;

an adder configured to sum the first filtered sense signal and the second filtered sense signal to provide a sum signal representing the sum of the first filtered sense signal and the second filtered sense signal;

a broadband active noise control filter configured to generate a filtered sum signal from the sum signal; and a loudspeaker configured to convert the filtered sum signal into anti-noise and to radiate the anti-noise to a listening position within the vehicle; wherein the filtered sum signal is configured so that the anti-noise reduces the road noise and engine sound.

15. The system of claim 14, wherein the broadband active noise control filter comprises:

a controllable filter electrically connected to the adder and upstream of the loudspeaker; and a filter controller configured to receive the sum signal and to control the controllable filter according to the filtered first signal and the filtered second signal.

16. The system of claim 15, further comprising a microphone disposed in an interior of the vehicle close at or adjacent to the listening position, wherein the microphone is configured to provide a microphone signal and the filter controller is configured to further control the controllable filter according to the microphone signal.

17. The system of claim 15, wherein the filter controller is configured to control the controllable filter according to a least mean square algorithm.

* * * * *